US006658125B1

(12) United States Patent
Batting

(10) Patent No.: US 6,658,125 B1
(45) Date of Patent: Dec. 2, 2003

(54) HEARING AID

(75) Inventor: Jes Anker Batting, Hellerup (DK)

(73) Assignee: Oticon A/S, Hellerup (DK)

( * ) Notice: Subject to any disclaimer, the term of this patent is extended or adjusted under 35 U.S.C. 154(b) by 0 days.

(21) Appl. No.: 09/807,001

(22) PCT Filed: Oct. 7, 1999

(86) PCT No.: PCT/DK99/00535

§ 371 (c)(1),
(2), (4) Date: May 17, 2001

(87) PCT Pub. No.: WO00/21336

PCT Pub. Date: Apr. 13, 2000

(30) Foreign Application Priority Data

Oct. 7, 1998 (DK) ..... 1998 01272

(51) Int. Cl.[7] ..... H04R 25/00
(52) U.S. Cl. ..... 381/330; 381/323; 381/322
(58) Field of Search ..... 381/314, 322, 381/323, 330, 327, 381, FOR 134, 324

(56) References Cited

U.S. PATENT DOCUMENTS

| | | | | |
|---|---|---|---|---|
| 3,138,491 A | | 6/1964 | Rubio | |
| 3,475,566 A | * | 10/1969 | Bauer | 381/323 |
| 4,638,125 A | * | 1/1987 | Buettner | 381/330 |
| 4,680,799 A | * | 7/1987 | Henneberger | 381/328 |
| 4,941,180 A | | 7/1990 | Buettner | |
| 4,947,439 A | * | 8/1990 | Buettner | 381/330 |
| 5,687,242 A | | 11/1997 | Iburg | |
| 6,522,764 B1 | * | 2/2003 | Bogeskow-Jensen | 381/330 |

FOREIGN PATENT DOCUMENTS

| | | |
|---|---|---|
| DE | 1161599 | 1/1964 |
| EP | 0388501 | 9/1990 |

* cited by examiner

*Primary Examiner*—Huyen Le
(74) *Attorney, Agent, or Firm*—Dykema Gossett PLLC

(57) ABSTRACT

A hearing aid includes a housing and a battery drawer at an end of the housing which is pivotable relative to the housing and includes a protruding portion which, when abutted against a surface, will cause the battery drawer to pivot to an open position so that electric power to the amplifier in the housing is disconnected.

2 Claims, 6 Drawing Sheets

HEARING AID

BACKGROUND OF THE INVENTION

The invention relates to a hearing aid comprising a housing, an amplifier within the housing and a battery as a power supply to the amplifier, the battery being placed in a battery drawer, which is mounted pivotally, where means are provided for disconnecting the power supply to the amplifier when the battery drawer is pivoted.

The handling of such hearing aids is cumbersome for many hearing aid users especially those suffering from rheumatism and arthritis. The lack of ability to handle the power disconnecting mechanism may lead to a situation where the hearing aid is turned on although this is not used, e.g. during the night. This of course leads to increased and unnecessary battery consumption.

The objective of the present invention is to provide a hearing aid of the above-mentioned type, which allows more users to handle the connecting and disconnecting mechanism of a hearing aid.

SUMMARY OF THE INVENTION

The objective of the invention is achieved by means of a hearing aid of the above mentioned type, which comprises battery drawer comprises a protruding part which when the housing is pressed towards a surface and the protruding part is in contact with the surface may force the battery drawer to pivot and to connect or disconnect, respectively, the power supply to the amplifier.

As the user now do not need to manipulate the mechanism itself but only need to hold the housing which has a significantly larger volume it is possible for a larger part of the users to handle the on/off mechanism of the hearing aid. This leads to a reduction of battery consumption and hence to a better economy in use of the hearing aid.

In a preferred embodiment the hearing aid according to the invention comprises comprising a battery drawer locking element which allows the pivoting to disconnect the power supply.

The invention will be described more detailed in the following with reference to the drawings.

DESCRIPTION OF THE PREFERRED EMBODIMENT

Figure 1:
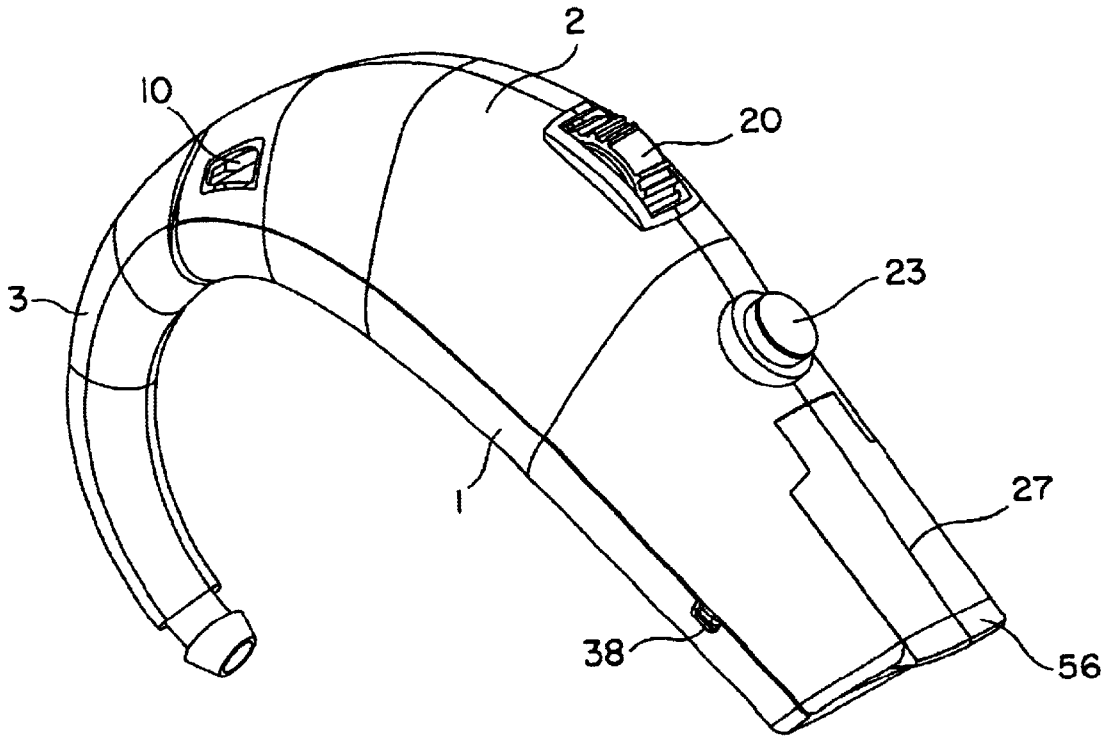
FIG. 1 is a perspective view of a hearing aid according to the invention.

FIG. 1 depicts a hearing aid according to the invention which comprises a generally crescent-shaped housing divided into a first shell part 1 and a second shell part 2. At the upper end (first end) of the housing a hook 3 is mounted in an adapter part. An acoustic inlet opening 10 appears as well as a volume control 20, an activating button 23 and a battery drawer 27. An aperture 38 for accessing a battery terminal appears. The protruding part 56 for opening the battery drawer and breaking the power supply appears clearly.

Figure 2:
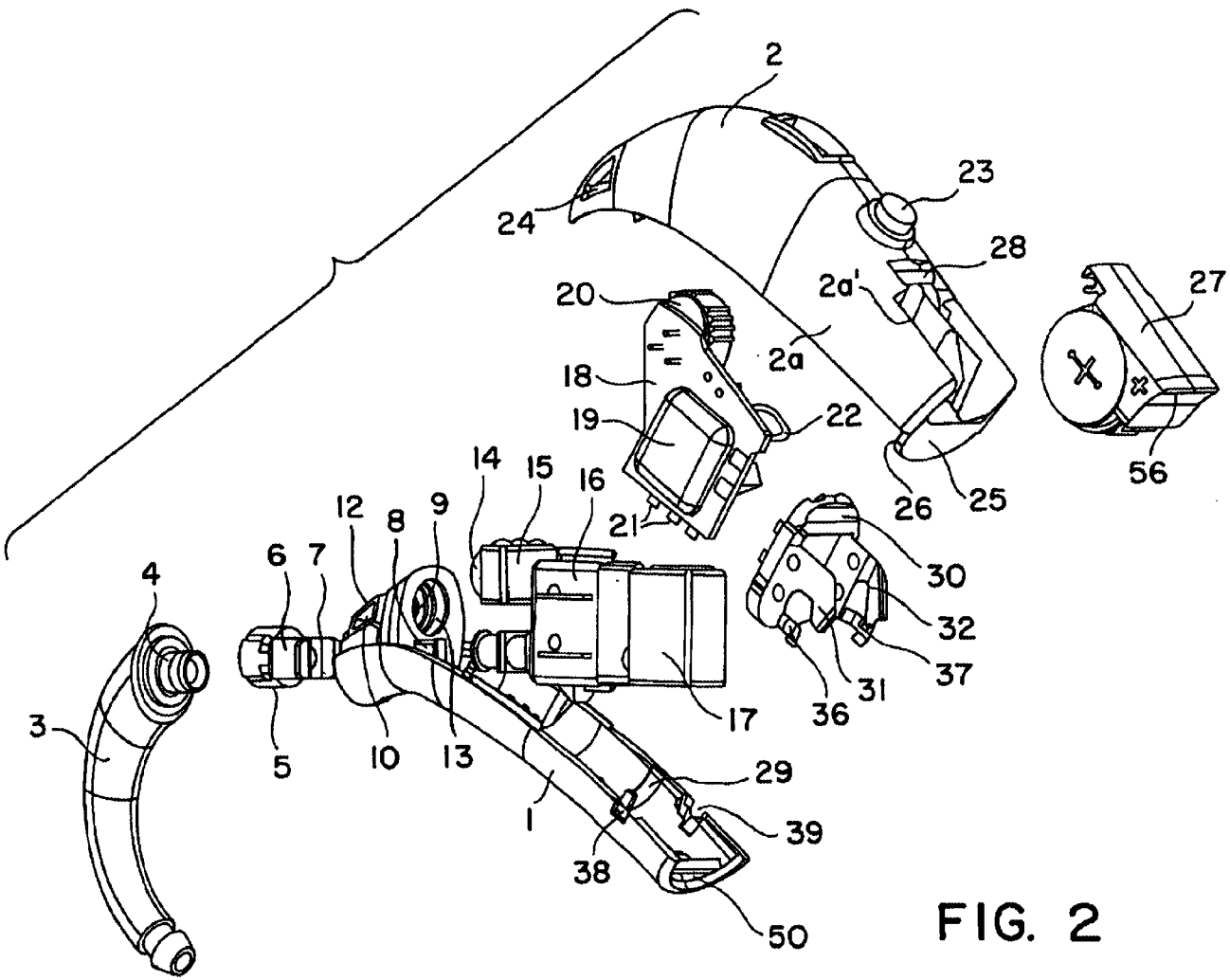
FIG. 2 is an exploded perspective view of the hearing aid shown in FIG. 1.

FIG. 2 shows an exploded view of the hearing aid of FIG. 1. The hook 3 comprises a circumferential recess 4 at the coupling end. It appears that the hook is mounted in an adapter part 5, which is mounted in an aperture in the first shell part 1 and his held in place by means of two flexible legs 6,7 having their outer ends barbs cooperating with internal shoulders around the aperture 8 in the first shell part. The opposite end of the adapter 5 comprises four flexible wall parts separated by incisions and having internal barbs adapted to cooperate with the recess 4 in the hook 3.

The first shell part comprises an acoustic inlet channel which at the outer end is branched into two opposed acoustic inlet openings (one acoustic inlet opening 10 is shown in FIG. 1) located at the sides of the first shell part. A thin protruding wall 12 surrounds each inlet opening. A the inner end the channel faces a cavity 13, for holding a microphone suspension 14 which holds the microphone 15. Beneath the cavity 13 for holding the microphone suspension and the microphone the above-mentioned aperture 8 for the hook adapted is situated. A receiver 17 is adapted to be placed in a receiver suspension 16, which is inserted into the aperture and into the adapter. The outer end of the suspension forms a seal against the hook 3 when this is mounted in the hook adapter.

In the first shell part holding means are provided for receiving and holding a circuitry board 18 which on its side holds an amplifier 19, a volume control 20, a telecoil (not visible), programming terminals 21 and a switch 22 adapted to be activated by the activating button 23. These holding means comprise holding slots 33, 34 (see FIG. 6) for the end areas of the board at one side edge of this. This means that the board is fixed in transversal as well as longitudinal translation and may be inserted and removed in a direction parallel to the board plane. Between the slots apertures 49 for the programming terminals on the circuitry board are provided for allowing access to these from the outer surface of the housing. At the end of the first shell part of a locking recess 50 is provided. A recess 29 is provided for receiving a terminal wall 30 being provided with terminals 31, 32 for contacting the battery and further terminal 36, 37 for external access through apertures 38, 39.

The second shell part comprise apertures 24 for receiving and surrounding the protruding walls 12 around the acoustic inlets 10, 11 on the first shell part. At the opposite end of the second shell part a locking arm 25 (second end of housing having a barb 26 is provided, this locking arm providing a generally flat exposed surface. This locking arm 25 and the barb 26 together with the apertures 24 at the opposite end of the second shell part and the protruding wall 12 and the locking recess 50 on the first shell part forms the releasable locking means of the two shell parts. In the second shell part the battery drawer is mounted to be pivotable around a shaft 28 relative to opening 2*a*' which has a portion in the side wall 2*a* of the housing and a portion in the second housing end 25. The two shell parts may be dismantled using a tool which comprises two arms adapted to be inserted between the first and the second shell part in the area where these are mutually connected at the acoustic inlets. Upon insertion the second shell part will be expanded to a state where this may be lifted away from the protruding wall parts and hereby may be released from the first shell part.

Figure 3:
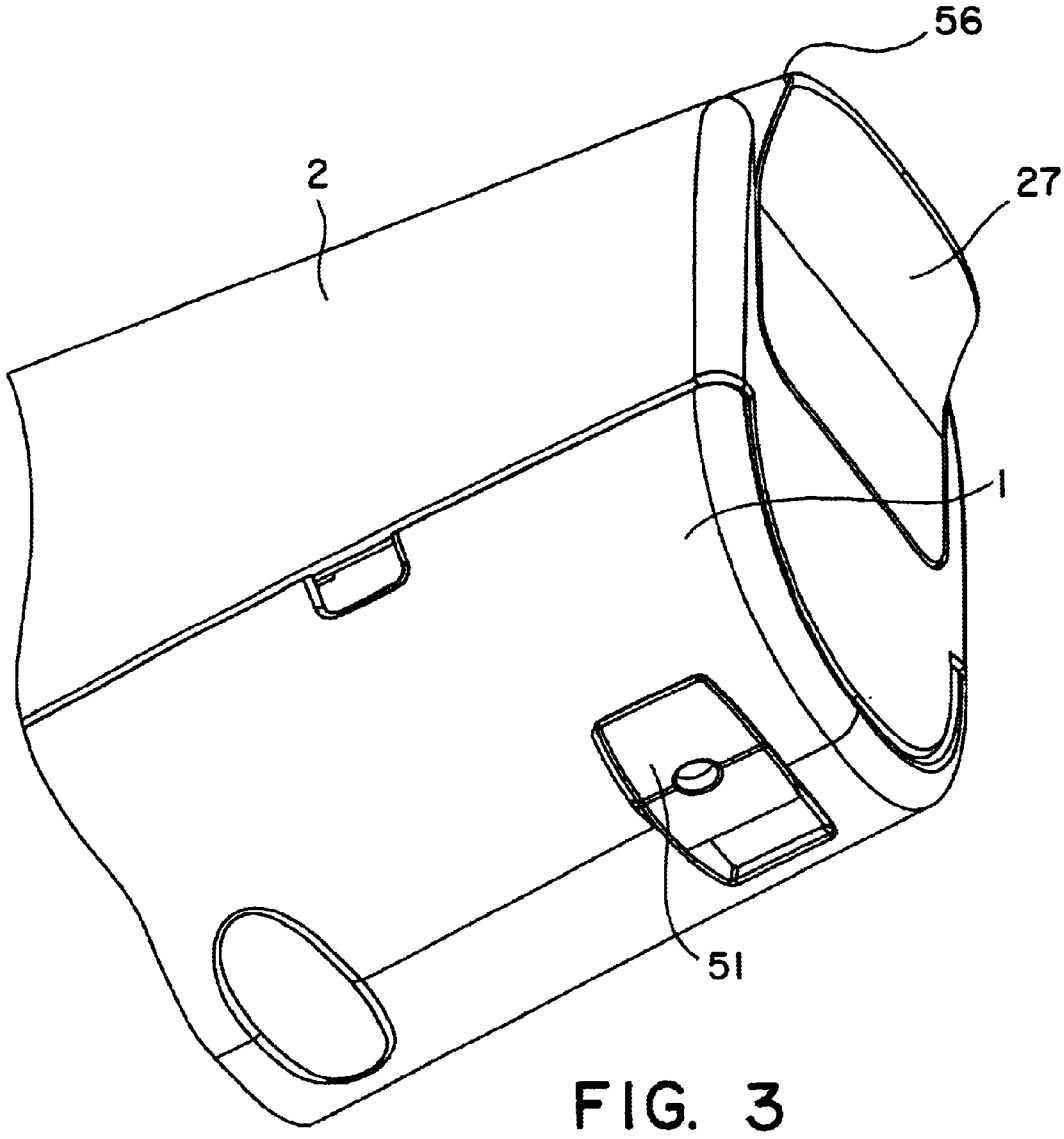
FIG. 3 is a front view of the housing.

From FIG. 3 the housing appears in a position where the locking element 51 is clearly visible. The locking element comprises a blind hole for insertion of an object for sliding the locking element sideways.

Figure 4:
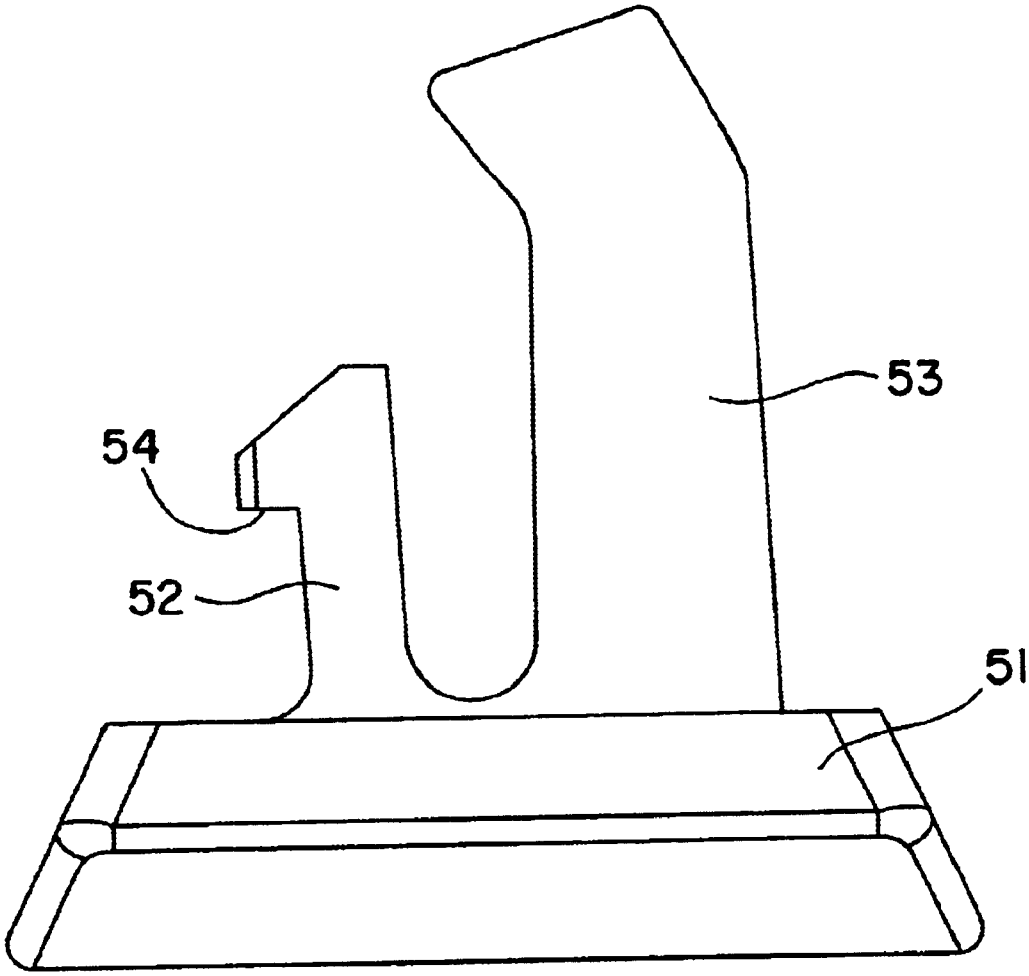
FIG. 4 is a side view of a locking element.

From FIG. 4 the locking element appear separately. The locking element comprises two legs 52,53, where one of these 52 has a barb 54for interlocking the locking element with the housing in a slidable manner.

Figure 5:
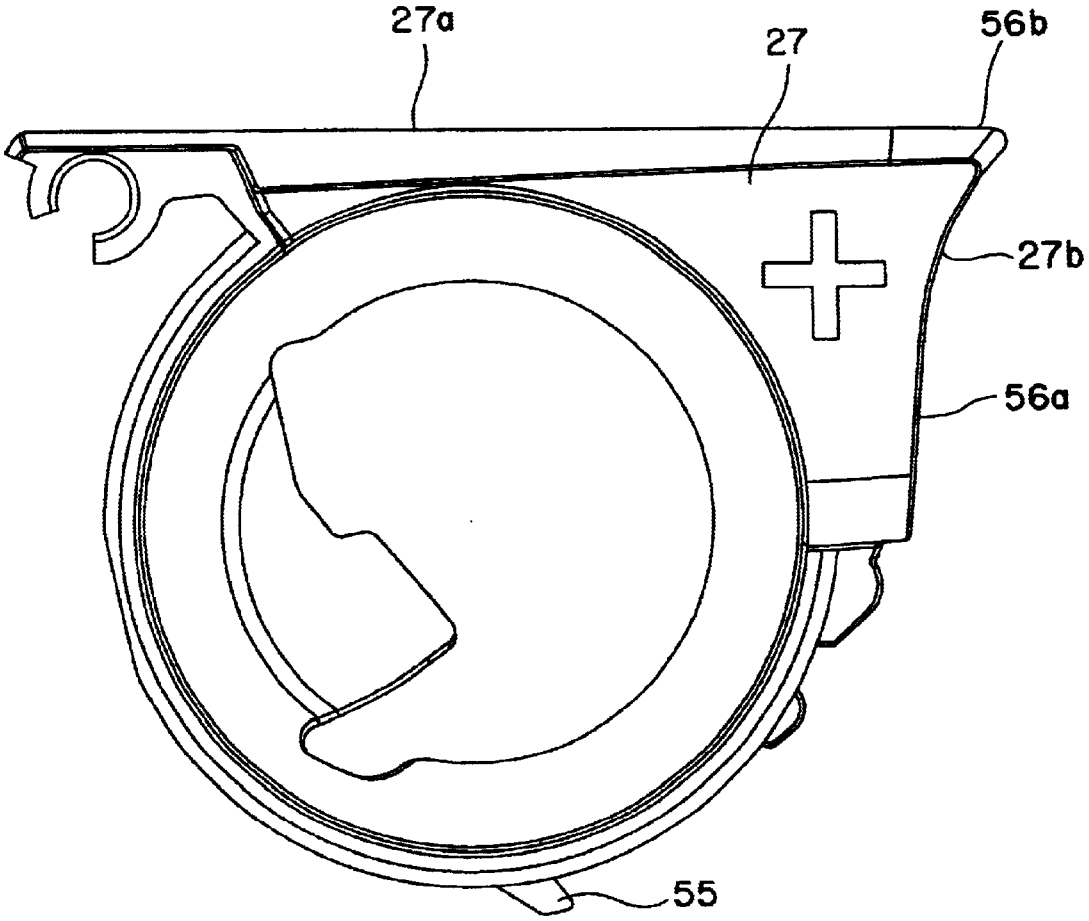
FIG. 5 is a side view of the battery drawer.

From FIG. 5 the battery 27 drawer appears. The battery drawer comprises a first portion 27*a* and a second portion 27*b* which defines a generally flat outer surface portion 56*a* and a projecting portion 56*b* as well as a tap 55 protruding in a direction perpendicular to the axis of rotation of the battery drawer. Furthermore the protruding part 56*b,* when the hearing aid is moved towards a surface, abuts the surface, which will force the battery drawer into an open position and hence break the power supply.

Figure 6:
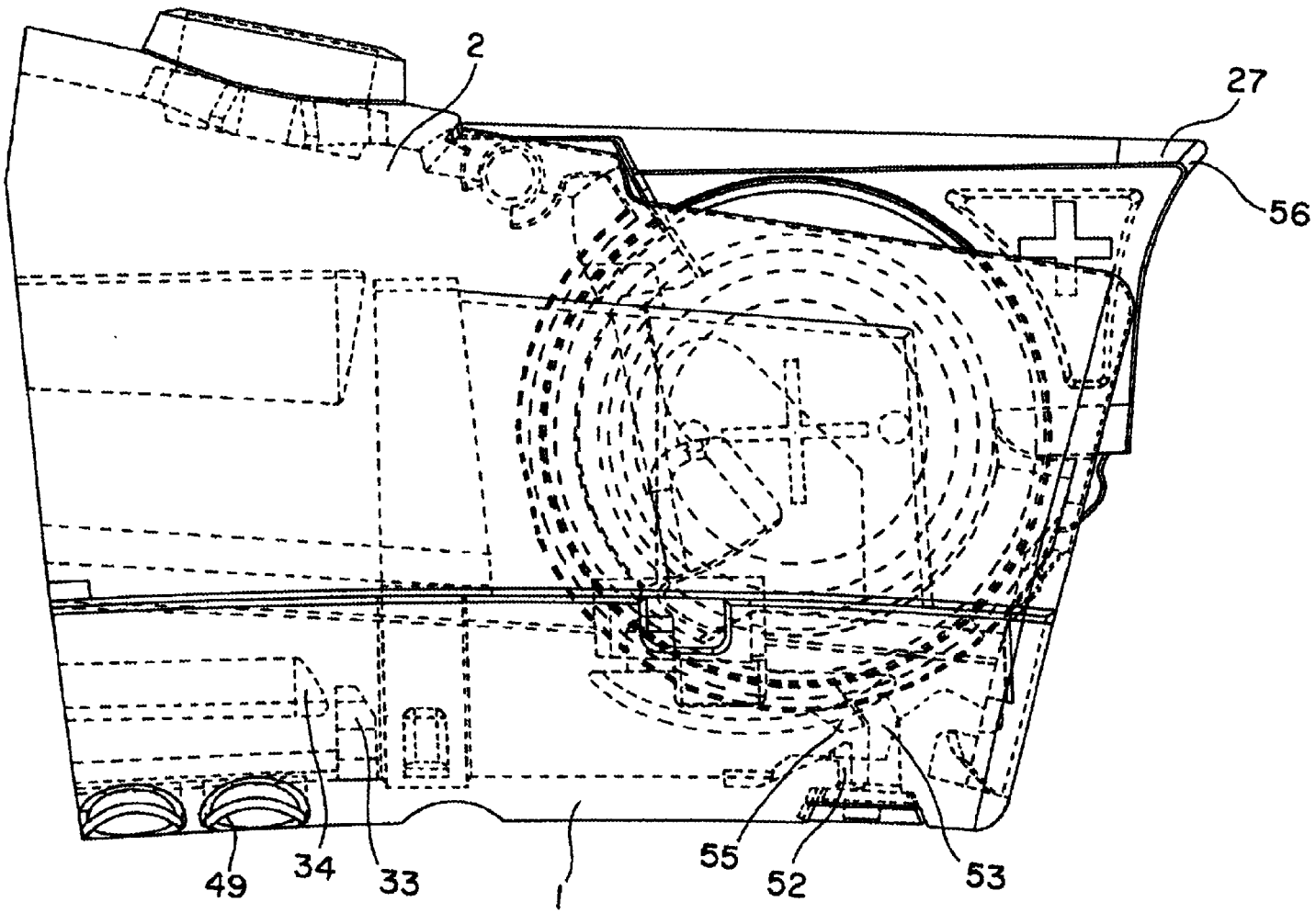
FIG. 6 is a view showing the battery drawer in an partly open position, where the power supply has been disconnected.

From FIG. 6 the battery drawer appears in a position where this has been pivoted and a tap or flap on this is introduced between the battery and at least one of the contact elements in the hearing aid housing. It appears that the protruding part in this position is almost aligned with the bottom part of the hearing aid housing.

Starting from the position of the battery drawer in FIG. 6 the battery drawer can easily be pivoted into a closed position where the power supply is reestablished. Simply forcing the protruding part against a surface does this. Again the movement is appropriate for person having reduced ability of using their hands and fingers.

What is claimed is:

1. A hearing aid comprising a generally crescent-shaped housing having a side wall and opposite first and second ends, said second end defining a generally flat exposed surface which is substantially perpendicular to a longitudinal axis of the housing, said housing providing an opening in said second end and an adjoining opening in said side wall that extends towards said first end; an amplifier mounted in the housing; and a battery drawer pivotally connected to said housing for containing a battery to power said amplifier and which can be pivoted from a first position wherein the battery contained therein is electronically connected to said amplifier to a second position wherein the battery contained therein is electrically disconnected from said amplifier, said battery drawer defining a first portion which extends in said opening in said side wall of the housing and which is pivotally connectable to said housing, and a second portion which extends in said opening in said second end of said housing, said second portion defining a generally flat outer surface portion that is generally coplanar with said generally flat exposed end surface of said second end of said housing when said battery drawer is in said first position and a projecting portion which projects away from said first generally flat outer surface portion, said projecting portion, when abutted against a surface, causing said battery drawer to pivot about said housing to said second position.

2. A hearing aid according to claim 1, including a locking element which allows the battery drawer to pivot to said second position.

* * * * *